US006134190A

United States Patent [19]

Kotanagi

[11] Patent Number: 6,134,190

[45] Date of Patent: Oct. 17, 2000

[54] ALARM SETTING MECHANISM FOR AN ELECTRONIC TIMEPIECE HAVING AN ALARM STATUS PATTERN ON THE FRONT OF THE TIMEPIECE DIAL

[75] Inventor: Susumu Kotanagi, Chiba, Japan

[73] Assignee: Seiko Instruments Inc., Japan

[21] Appl. No.: 08/926,892

[22] Filed: Sep. 10, 1997

[30] Foreign Application Priority Data

Oct. 11, 1996 [JP] Japan ..... 8-270132

[51] Int. Cl.[7] ..... G04B 23/02; G04C 21/00

[52] U.S. Cl. ..... 368/74; 368/249

[58] Field of Search ..... 368/72–74, 80, 368/249, 250

[56] References Cited

U.S. PATENT DOCUMENTS

| | | | |
|---|---|---|---|
| 1,462,142 | 7/1923 | Lux | 368/74 |
| 1,916,033 | 9/1933 | Baltsois | 368/249 |
| 4,422,775 | 12/1983 | Thoenig | 368/74 |

*Primary Examiner*—Vit Miska

*Attorney, Agent, or Firm*—Adams & Wilks

[57] ABSTRACT

An alarm setting mechanism for an electronic timepiece has a linkage for converting displacement of an alarm activating stem into a larger displacement of an alarm status indicating member which traverses an arcuate path on the front face of a dial of the timepiece. An alarm switching mechanism sets an alarm by activation of a stem on the timepiece which is connected to the alarm status indicator and the alarm switching mechanism. The linkage includes a pivotable switching lever, a pivotable setting lever and a rotatable alarm indicator plate. The setting lever is connected to the stem to undergo pivotal movement in response to linear displacement of the stem. The switching lever is connected to the setting lever to undergo pivotal movement along with the setting lever and having an arm. The alarm indicator plate is connected to the arm of the switching to undergo rotational movement in response to pivotal movement of the switching lever. The alarm status indicating member is connected to the alarm indicator plate so as to undergo arcuate movement therewith, such that the indicating member traverses an arcuate path in response to linear displacement of the externally activated switch.

19 Claims, 4 Drawing Sheets

ALARM SETTING MECHANISM FOR AN ELECTRONIC TIMEPIECE HAVING AN ALARM STATUS PATTERN ON THE FRONT OF THE TIMEPIECE DIAL

BACKGROUND OF THE INVENTION

The present invention relates to an alarm setting mechanism electronic timepiece having alarm status visual indication means for providing a visual display of alarm status.

As shown in FIG. 6, in a conventional alarm status visual indication means, an alarm switching mechanism is operated by the axial operation of an external operate stem 14, by which an alarm switch lever 15 is moved. The alarm switch lever 15 has a color print pattern 15*a* therein so as to allow one to visually discriminate the alarm status indication against a dial plate. By the operation of the alarm switch lever 15, a print portion 15*a* of the alarm switch lever 15 is indicated through a window 16*a* of a dial 16 to check the function switching.

In the conventional alarm status visual indication means, a dial 16 requires the window 16*a* for indication, and the alarm switch lever 15 requires color print pattern 15*a* or a character print pattern. The indication under the dial 16 and the rotation angle of the alarm switch lever 15 are limited, so that the window shape cannot be increased to enable clearer visibility in a small timepiece, resulting in a difficulty in discriminating an alarm status indication. Also, the design is limited, so that the design development is difficult.

SUMMARY OF THE INVENTION

According to the present invention, converting means converts the linear, axial switching operation of the external operate stem into the pivotal movement of an alarm switch lever and an alarm indicator axle. A hand is attached to the tip end of the alarm indicator axle, and an alarm status indication pattern is provided on the upper face of the dial. Thus, by providing an alarm status indication pattern on the upper face of the dial rather than behind the dial, the switching indication is easy to see, and the design development is made easy. Since the indication structure is simple, the assembly of switching parts is also easy.

DETAILED DESCRIPTION OF THE PREFERRED EMBODIMENTS

In the alarm setting mechanism of an electronic timepiece in accordance with the present invention, a correction mechanism, which can correct the alarm setting time by using the external operate stem, is provided with a alarm status indication means.

The alarm status indication means provided a visual indication printed on the upper face of the dial by using an alarm setting indicator hand. An axle to which the alarm setting indicator hand is attached is rotated by the operation of the external operate stem. Converting means converts the linear, axial operation of the external operate stem into the pivotal movement of the alarm indicator axle by a lever member, for example. The tip of the alarm status indicating hand traverses a path of greater distance than that of the linear movement of the externally operated stem.

In one embodiment, in order to convert the axial operation of the external operate stem into pivotal movement of the alarm indicator axle, a set of gear teeth is formed on the lever member to engage with a corresponding set of gear teeth formed in the alarm indicator axle. The lever member is rotated by the engagement between the lever member and the external operate stem. Since the gear teeth formed on the lever member and the gear teeth on the alarm indicator axle are engaged with each other, the alarm indicator axle is rotated.

Figure 1:
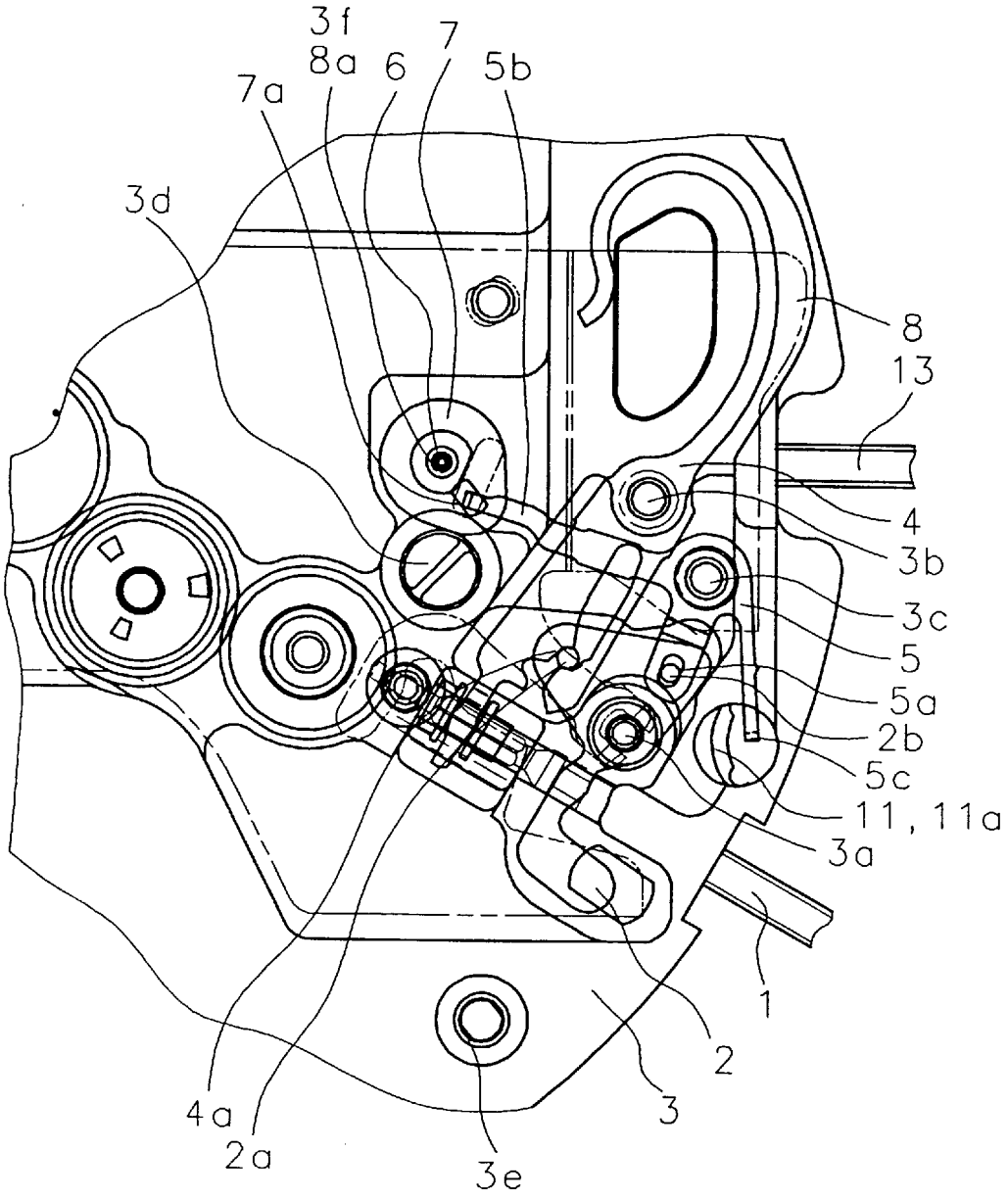
FIG. 1 is a plan view of a alarm status indication structure for an alarm setting mechanism of an electronic timepiece in accordance with the present invention.
Figure 2:
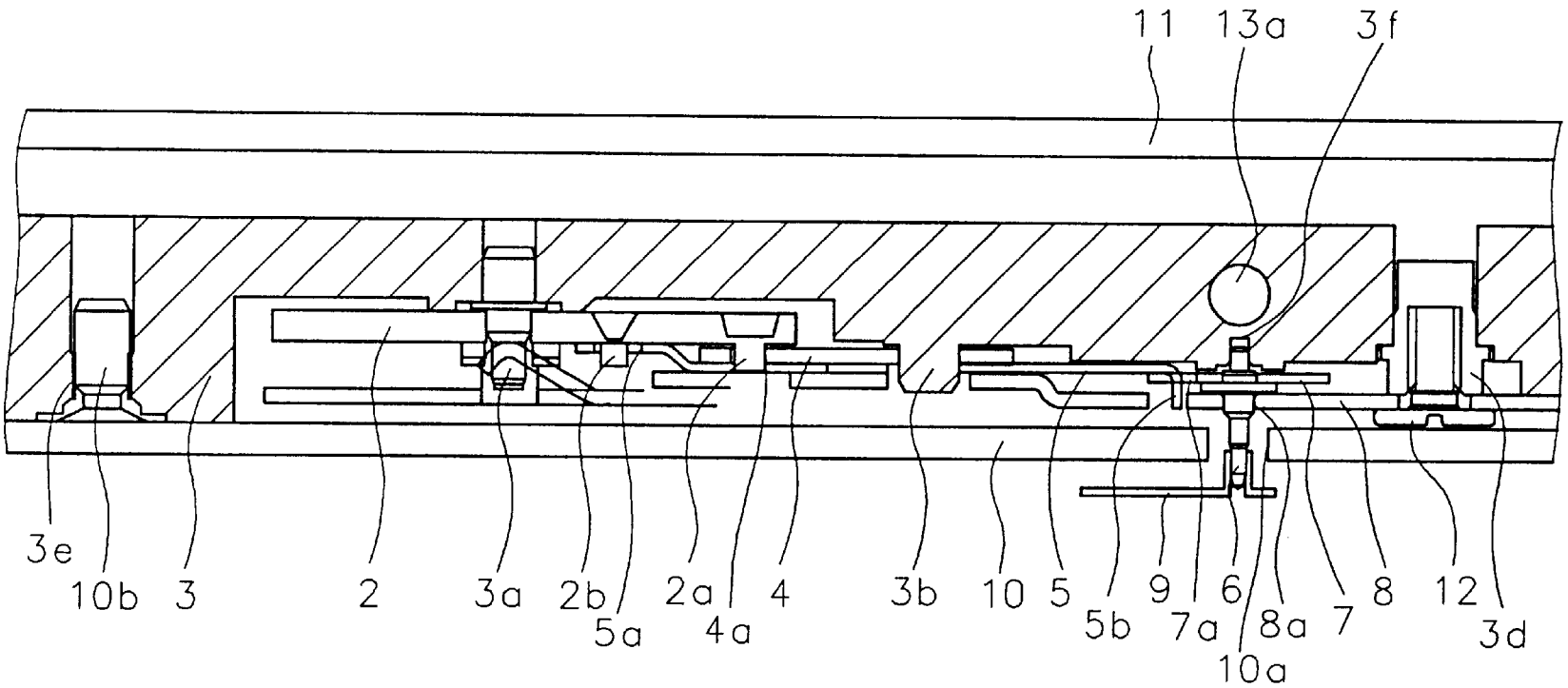
FIG. 2 is a sectional view of a alarm status indication structure for an alarm setting mechanism of an electronic timepiece in accordance with the present invention.
Figure 3:
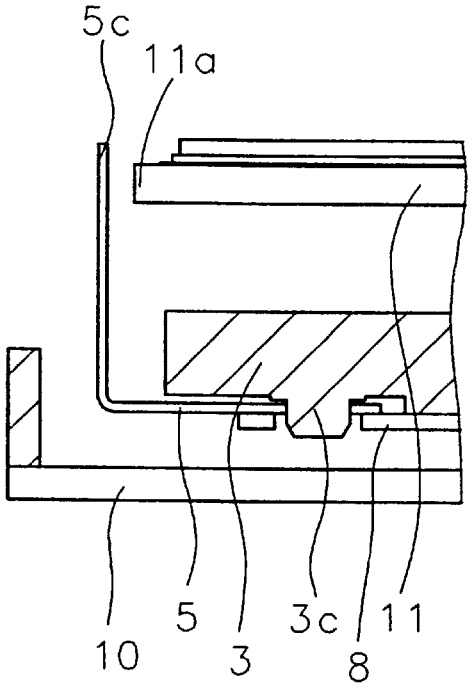
FIG. 3 is a sectional view of a alarm status indication structure for an alarm setting mechanism of an electronic timepiece in accordance with the present invention.

Embodiments of the present invention will be described with reference to the accompanying drawings. FIG. 1 is a plan view of an alarm status indication structure for an alarm setting mechanism of an electronic timepiece in one embodiment in accordance with the present invention. FIGS. 2 and 3 are sectional views of a switching indication structure for an alarm setting mechanism of an electronic timepiece in one embodiment in accordance with the present invention.

In FIGS. 1 to 3, reference numeral 1 denotes an external operated stem. By pulling out the external operated stem 1, a series of components, as described hereinafter, cooperate to convert the linear movement of the stem into arcuate movement of an alarm status indicating hand. The converting means includes an engaging setting lever 2 which pivots around a center shaft 3*a* driven in a main plate 3. A yoke 4 pivots around a center shaft 3*b*, and performs the positioning of pivotal movement of the setting lever 2 by the engagement between a pin 2*a* formed on the setting lever 2 and an angle 4*a* of the yoke 4. A pin 2*b* formed on the setting lever 2 engages with a window 5*a* formed on an alarm switch lever 5. The alarm switch lever 5 is pivoted about a center shaft 3*c*, and this pivotal movement is activated by the setting lever 2. The alarm switch lever 5 is provided with an arm 5*b* in the direction opposite to a portion engaging with the setting lever 2. An alarm indicator plate 7 is driven to an alarm indicator axle 6, and has a window 7*a*. The rotation center of the alarm indicator axle 6 is supported by a mortice 3*f* arranged at an upper part 13*a* of a winding stem 13 supported at the side of the main plate 3, for example, and a mortice 8*a* formed in a support for dial side parts 8. The end of the arm 5*b* of the alarm switch lever 5 is provided with a bend, which engages with the window 7*a* formed in the alarm indicator plate 7 driven to the alarm indicator axle 6. The rotation of the alarm switch lever 5 rotates the alarm indicator axle 6 by the arm 5*b* of the alarm switch lever 5 and a window 7*a* formed in the alarm indicator plate 7. The setting lever 2, yoke 4, alarm switch lever 5, and alarm indicator axle 6 are supported by the support for dial side parts 8. The support for dial side parts 8 is fixed to a pin 3*d* driven in the main plate 3 by using a screw 12 etc. The alarm indicator axle 6 is fitted with an alarm setting indicator hand 9 to give switching indication printed on a dial 10.

The operation of the alarm switching indication structure in accordance with the present invention will be described in detail. When the external operate stem 1 is pulled out, the setting lever 2 is rotated around the center shaft 3*a* of the main plate 3. The pin 2*b* formed on the setting lever 2 and the window 5*a* formed in the alarm switch lever 5 are engaged with each other, so that the alarm switch lever 5 is rotated around the center shaft 3*b*. The other end of the alarm switch lever 5 is provided with a contact portion 5*c* which is in contact with a switch pattern 11*a* of a circuit block 11. By the rotation of the setting lever, the alarm switch lever 5 is rotated around the center shaft 3*c*. By the rotation of the alarm switch lever 5, the contact portion 5*c* of the alarm switch lever 5 comes into contact with the switch pattern 11*a* of the circuit block 11, by which electrical function switching is effected. When the external operate stem 1 is pulled, the contact portion 5*c* of the alarm switch lever 5 comes into contact with the switch pattern 11*a* of the circuit block 11, so that electrical ON state is established. Also, the arm 5*b* of the alarm switch lever 5 engages with the window 7*a* formed on the dial 7 driven to the alarm indicator axle 6, by which the alarm indicator axle 6 is rotated. The dial 10 is provided with a hole 10*a* through which the alarm indicator axle 6 passes. The dial 10 is fixed by screwing a pin 10*b* formed on the back face of the dial 10 into a dial hole 3*e* formed in the main plate 3. The alarm indicator axle 6 is fitted with the alarm setting indicator hand 9, and the content of switching indication is printed on the upper face of the dial 10 in the rotation range of the alarm setting indicator hand 9. By the rotation of the alarm indicator axle 6, the alarm setting indicator hand 9 gives the switching indication printed on the upper face of the dial 10. Therefore, simultaneously with electrical function switching, the function switching indication can be given on the upper face of the dial 10 by a hand.

Figure 4:
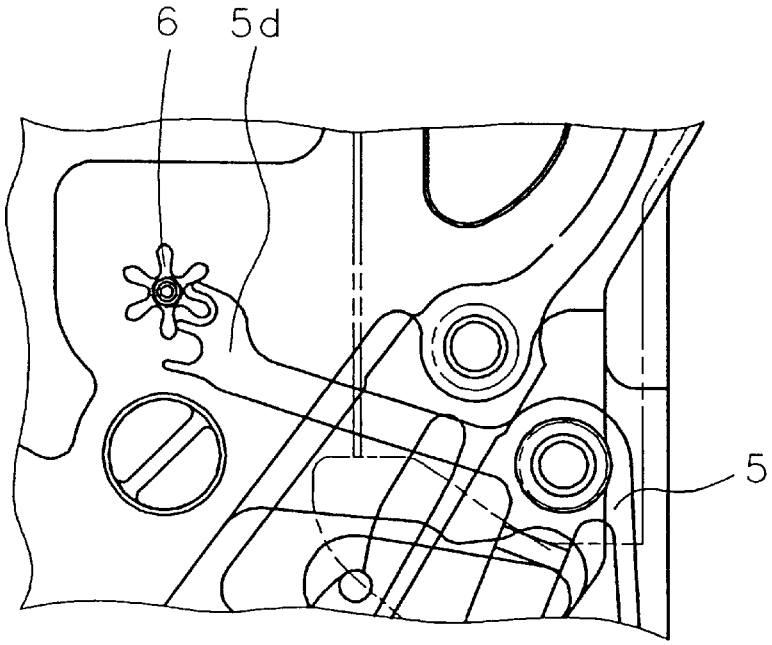
FIG. 4 is a plan view of another embodiment of a structure in which an alarm indicator axle is rotated.
Figure 5:
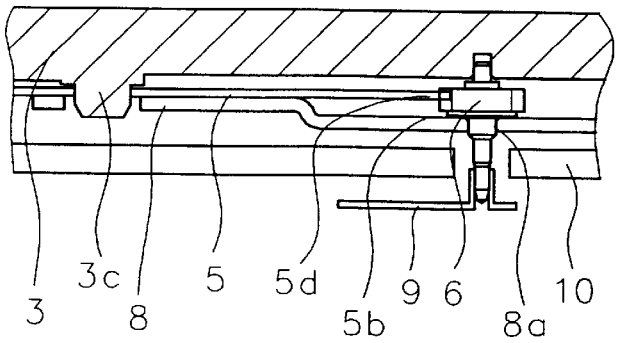
FIG. 5 is a sectional view of another embodiment of a structure in which an alarm indicator axle is rotated.
Figure 6:
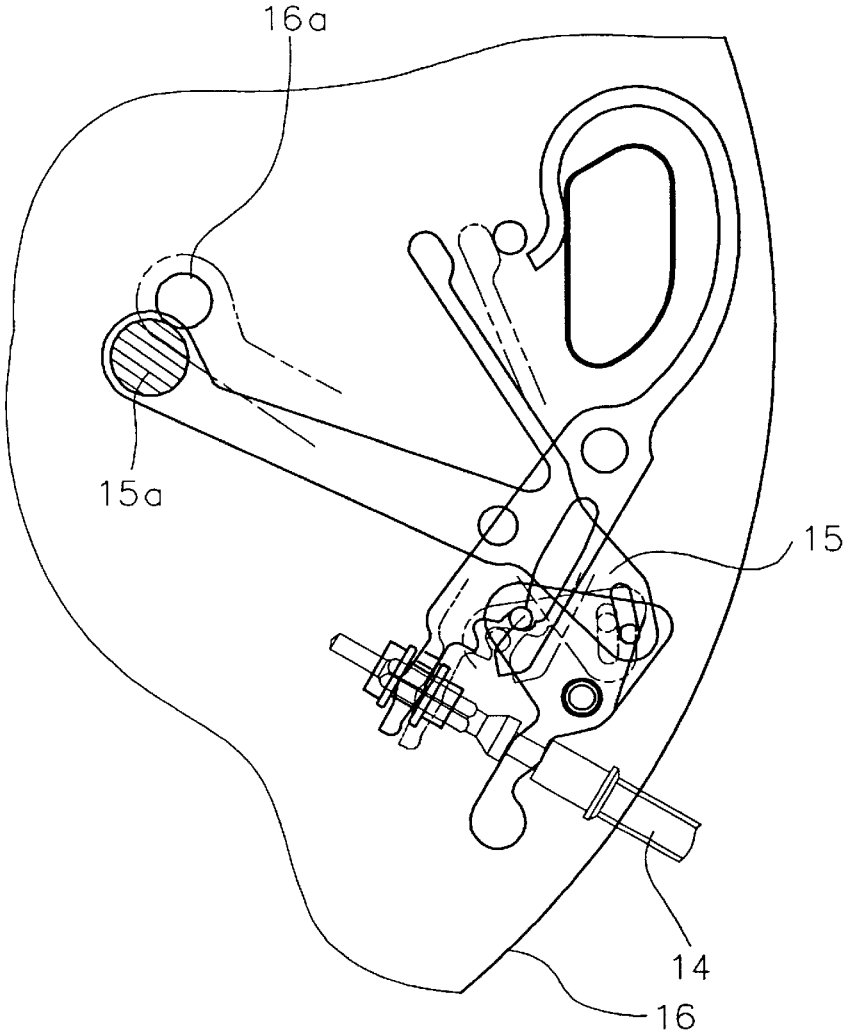
FIG. 6 PRIOR ART
FIG. 6 is a plan view of a conventional alarm status indication structure.

FIG. 4 is a plan view showing another embodiment of a structure for rotating the alarm indicator axle 6. FIG. 5 is a sectional view showing another embodiment of a structure for rotating the alarm indicator axle 6. In FIGS. 4 and 5, gear teeth are formed at the end of an arm 5*d* of the alarm switch lever 5, and corresponding gear teeth are also formed on the alarm indicator axle 6. By the arrangement in which the teeth of the alarm switch lever 5 engage with the teeth of the alarm indicator axle 6, the rotation of the alarm switch lever 5 is transmitted to the alarm indicator axle 6, by which the alarm indicator axle 6 is rotated. By the rotation of the alarm indicator axle 6, the alarm setting indicator hand 9 can give the switching indication printed on the upper face of the dial 10.

According to the present invention, in the alarm function switching indication means for an alarm setting mechanism of an electronic timepiece, by the operation of the external operate stem, the alarm setting indicator hand attached to the alarm indicator axle provides a visual switching indication printed on the upper face of the timepiece dial 10, so that the switching indication is easy to see. Also, because of the indication by a hand, the design development is also made easy. The switching indication structure in accordance with the present invention can arrange parts in a limited space and can be constructed easily.

What is claimed is:

1. An alarm setting mechanism for an electronic timepiece, comprising: alarm status indication means for providing a visual indication of alarm status on an upper face of a dial of the electronic timepiece, the alarm status indication means having an indicating member extending over the upper face of the timepiece dial and being displaceable with respect to alarm status indicating indicia provided on the upper face of the timepiece dial to provide a visual indication of alarm status; an alarm switching mechanism for setting an alarm; an externally activated switch mounted to a case of the timepiece and connected to the alarm status indication means and the alarm switching mechanism; and converting means for converting movement of the switch in response to external activation thereof into movement of the indicating member so that the indicating member traverses a path of greater distance than that of the switch, by which a highly visible alarm status indication is provided on the upper face of the timepiece dial.

2. An alarm setting mechanism for an electronic timepiece according to claim 1; wherein the alarm switching mechanism comprises the switch, and a switching lever mounted to undergo pivotal movement in response to linear movement of the externally operated switch and having a contact for establishing an electrical connection with a contact of an alarm circuit of the electronic timepiece to set an alarm.

3. An alarm setting mechanism for an electronic timepiece according to claim 2; wherein the switching lever is mounted to undergo pivotal movement in response to pivotal movement of a setting lever which is connected to undergo movement in response to movement of the externally operated switch.

4. An alarm setting mechanism for an electronic timepiece according to any one of claims 1 to 3; wherein the alarm status indication means further comprises an alarm indicator plate connected to the indicating member and mounted to undergo pivotal movement in response to pivotal movement of the switching lever so as to cause the indicating member to undergo pivotal, movement therewith, the alarm indicator plate being attached to an alarm indicator axle which is integral with the alarm indicator plate.

5. An alarm setting mechanism for an electronic timepiece according to claim 4; wherein the alarm indicator axle constitutes the final part of the alarm status indication means.

6. An alarm setting mechanism for an electronic timepiece according to claim 2; wherein the alarm indicator axle has a plurality of gear teeth and the switching lever has a plurality of gear teeth engageable with the gear teeth of the axle.

7. An alarm setting mechanism for an electronic timepiece according to any one of claims 1 to 6; wherein the externally activated switch comprises a winding stem of the electronic timepiece and the alarm status indication means is arranged at an upper part of the winding stem.

8. An alarm setting mechanism for an electronic timepiece according to claim 1; wherein the externally activated switch comprises a linearly displaceable stem.

9. An alarm setting mechanism for an electronic timepiece according to claim 1; wherein the converting means comprises a first pivotable lever connected to the externally activated switch to undergo pivotal movement in response to linear displacement of the switch, a second pivotable lever connected to the first pivotable lever to undergo pivotal movement along with the first pivotable lever and having an arm, and a rotatable disc connected to the arm of the second pivotable lever to undergo rotational movement in response to pivotal movement of the second pivotable lever, the indicating member being connected to the rotatable disc so as to undergo arcuate movement therewith, such that the indicating member traverses an arcuate path in response to linear displacement of the externally activated switch.

10. An alarm setting mechanism for an electronic timepiece according to claim 4; wherein the converting means comprises the switching lever, the setting lever and the alarm indicator plate, the setting lever being connected to the externally activated switch to undergo pivotal movement in response to linear displacement of the switch, the switching lever being connected to the setting lever to undergo pivotal movement along with the setting lever and having an arm, and the alarm indicator plate being connected to the arm of the switching to undergo rotational movement in response to pivotal movement of the switching lever, the indicating member being connected to the alarm indicator plate so as to undergo arcuate movement therewith, such that the indicating member traverses an arcuate path in response to linear displacement of the externally activated switch.

11. An alarm setting mechanism for an electronic timepiece, comprising: alarm status indication means for providing a visual indication of alarm status on an upper face of a dial of the electronic timepiece; an alarm switching mechanism for setting an alarm; an externally activated switch mounted to a case of the timepiece and connected to the alarm status indication means and the alarm switching mechanism; and converting means for converting movement of the switch in response to external activation thereof into movement of an alarm status indicating member of the alarm status indicating means so that the alarm status indicating member traverses a path of greater distance than that of the switch, by which a highly visible alarm status indication is provided on the upper face of the timepiece dial.

12. An alarm setting mechanism for an electronic timepiece according to claim 11; wherein the alarm status indication means has an alarm status indicating hand extending over the upper face of the timepiece dial and being displaceable with respect to alarm status indicating indicia provided on the upper face of the timepiece dial to provide a visual indication of alarm status.

13. An alarm setting mechanism for an electronic timepiece according to claim 11; wherein the alarm switching mechanism comprises the externally activated switch, and a switching lever mounted to undergo pivotal movement in response to linear movement of the externally operated switch and having a contact for establishing an electrical connection with a contact of an alarm circuit of the electronic timepiece to set an alarm.

14. An alarm setting mechanism for an electronic timepiece according to claim 13; further comprising a setting lever connected to the externally activated switch so as to undergo pivotal movement in response to linear displacement of the externally activated switch, wherein the switching lever is connected to the setting lever and mounted to undergo pivotal movement in response to pivotal movement of the setting lever.

15. An alarm setting mechanism for an electronic timepiece according to claim 14; wherein the alarm status indication means further comprises an alarm indicator plate connected to the indicating member and the switching lever and mounted to undergo pivotal movement in response to pivotal movement of the switching lever so as to cause the indicating member to undergo pivotal movement therewith, the alarm indicator plate being attached to an alarm indicator axle which is integral with the alarm indicator plate.

16. An alarm setting mechanism for an electronic timepiece according to claim 15; wherein the converting means comprises the switching lever, the setting lever and the alarm indicator plate, the setting lever being connected to the externally activated switch to undergo pivotal movement in response to linear displacement of the switch, the switching lever being connected to the setting lever to undergo pivotal movement along with the setting lever and having an arm, and the alarm indicator plate being connected to the arm of the switching to undergo rotational movement in response to pivotal movement of the switching lever, the indicating member being connected to the alarm indicator plate so as to undergo arcuate movement therewith, such that the indicating member traverses an arcuate path in response to linear displacement of the externally activated switch.

17. An alarm electronic timepiece according to claim 15; wherein the alarm indicator axle has a plurality of gear teeth and the switching lever has a plurality of gear teeth engageable with the gear teeth of the axle.

18. An alarm electronic timepiece according to claim 17; wherein the externally operated switch comprises a winding stem of the electronic timepiece and the alarm status indication means is arranged at an upper part of the winding stem.

19. An alarm setting mechanism for an electronic timepiece according to claim 11; wherein the converting means comprises a first pivotable lever connected to the externally activated switch to undergo pivotal movement in response to linear displacement of the switch, a second pivotable lever connected to the first pivotable lever to undergo pivotal movement along with the first pivotable lever and having an arm, and a rotatable disc connected to the arm of the second pivotable lever to undergo rotational movement in response to pivotal movement of the second pivotable lever, the indicating member being connected to the rotatable disc so as to undergo arcuate movement therewith, such that the indicating member traverses an arcuate path in response to linear displacement of the externally activated switch.

* * * * *